US006385935B2

(12) United States Patent
Lippy

(10) Patent No.: US 6,385,935 B2
(45) Date of Patent: May 14, 2002

(54) ASSEMBLY AND METHOD FOR ATTACHING INSULATION MATERIAL

(75) Inventor: William A. Lippy, Lakeland, FL (US)

(73) Assignee: Fi-Foil Company, Inc., Auburndale, FL (US)

( * ) Notice: Subject to any disclaimer, the term of this patent is extended or adjusted under 35 U.S.C. 154(b) by 0 days.

(21) Appl. No.: 09/730,994

(22) Filed: Dec. 6, 2000

Related U.S. Application Data

(63) Continuation-in-part of application No. 09/363,570, filed on Jul. 29, 1999.

(51) Int. Cl.[7] ..... E04B 1/38

(52) U.S. Cl. ..... 52/512; 52/404.2; 52/712; 411/396

(58) Field of Search ..... 52/512, 404.1, 52/404.2, 407.3, 481.1, 712; 24/295, 547; 411/396, 506, 900

(56) References Cited

U.S. PATENT DOCUMENTS

| | | | | |
|---|---|---|---|---|
| 1,612,075 A | | 12/1926 | Tapman | |
| 1,889,770 A | | 12/1932 | Black | |
| 2,015,129 A | | 9/1935 | Voigt et al. | |
| 2,584,194 A | | 2/1952 | Drury | |
| 2,814,840 A | | 12/1957 | Sears | |
| 3,174,256 A | | 3/1965 | Lockwood | |
| 3,181,662 A | | 5/1965 | Maertzig, Jr. | |
| 3,225,504 A | | 12/1965 | Gregoire | |
| 3,300,924 A | | 1/1967 | Ashby et al. | |
| 3,495,368 A | | 2/1970 | Krause | |
| 3,815,309 A | | 6/1974 | Olsen | |
| 4,069,738 A | | 1/1978 | McClure | |
| 4,150,465 A | | 4/1979 | Gavin, Jr. | |
| 4,296,530 A | | 10/1981 | Muller et al. | |
| 4,370,840 A | | 2/1983 | Bisbee et al. | |
| 4,649,689 A | | 3/1987 | Everman et al. | |
| 4,653,241 A | | 3/1987 | Bindi | |
| 4,959,939 A | * | 10/1990 | Buchanan, Jr. | 52/462 |
| 4,995,215 A | | 2/1991 | Menchetti | |
| 4,995,605 A | * | 2/1991 | Conville | 52/770 |
| 5,299,403 A | | 4/1994 | Fentz | |
| 5,417,530 A | | 5/1995 | Grossner | |
| 5,426,905 A | | 6/1995 | Rollhauser et al. | |
| 5,791,719 A | * | 8/1998 | Alley | 296/91 |
| 5,987,714 A | * | 11/1999 | Smith | 24/295 |
| 5,992,122 A | * | 11/1999 | Rohrmoser et al. | 52/698 |
| 6,067,691 A | * | 5/2000 | Feltman | 24/295 |
| 6,070,837 A | | 6/2000 | Bond | |

OTHER PUBLICATIONS

Advertisement in Insulation Outlook Magazine, May 1998.

* cited by examiner

*Primary Examiner*—Bruce A. Lev
(74) *Attorney, Agent, or Firm*—Robert L. Wolter; Beusse, Brownlee, Bowdoin & Wolter, PA

(57) ABSTRACT

An assembly and method for attaching insulation material includes a frame member having a generally vertically-extending flange. A clip has a pair of resilient grabbing members that define an aperture for receiving the flange. A plate member extends generally perpendicular relative to the grabbing members. The plate member includes an opening. A pin having a sharp end extends through the opening in the plate member. A set of washers is connected to the pin to retain insulation material pierced by the pin and to retain the pin in the opening in the plate member.

18 Claims, 3 Drawing Sheets

ASSEMBLY AND METHOD FOR ATTACHING INSULATION MATERIAL

This application is a continuation-in-part of U.S. patent application Ser. No. 09/363,570 filed on Jul. 29, 1999.

FIELD OF THE INVENTION

The field of this invention relates to the installation of insulation materials in buildings and similar structures, and more specifically, to an assembly and method utilizing a clip and pin combination for attaching insulation to a frame member.

BACKGROUND OF THE INVENTION

The installation of insulation material in buildings may require that the insulation be attached to a frame member of the structure. Generally, pins have been welded or glued to the frame member and then the insulation material is attached using the pins. This has presented several problems. First, the welding and gluing processes are time consuming, which makes the attachment of the insulation material tedious and inefficient. This often leads to installation and construction delays, inefficient utilization of labor, and increased installation and construction costs. Second, the bonds created by the welding and gluing processes may weaken over time, causing the pin and thus the insulation to become detached from the frame member. Third, the pins are often attached to the frame member at unaligned positions of the member, resulting in uneven or crooked alignment of the insulation material.

Although U.S. Pat. No. 2,584,194 to Drury appears to disclose a securing device for affixing insulation material to a strip steel framing member, this device is believed to have several drawbacks. First, the insulation material must be specially manufactured to include a tab that can be clamped to the frame member. Second, the clamping pressure applied to this tab may cause the insulation material to tear, resulting in the detachment of the insulation material from the frame member. Third, even if the insulation material does not tear, the tab may be pulled out of the clip, causing the insulation material to become detached from the frame member.

Accordingly, it is desirable to provide an assembly for attaching insulation material to a frame member that overcomes the above disadvantages.

SUMMARY OF THE INVENTION

Generally speaking, the present invention fulfills the foregoing needs by providing in one aspect thereof an assembly for attaching insulation material. The assembly in combination includes a frame member having a generally vertically-extending flange. A clip has a pair of resilient grabbing members that define an aperture for receiving the flange. A plate member extends generally perpendicular relative to the grabbing members. The plate member includes an opening. A pin having a sharp end extends through the opening in the plate member. A set of washers is connected to the pin to retain insulation material pierced by the pin and to retain the pin in the opening in the plate member.

The present invention further fulfills the foregoing needs by providing, in another aspect thereof, a method for attaching insulation material. The method allows for providing a frame member with a generally vertically-extending flange. The method further allows for grabbing the flange with a clip having a pair of resilient grabbing members defining an aperture for receiving the flange. A plate member extends generally perpendicular relative to the grabbing members and includes at least one opening. An inserting action allows for inserting a respective pin through the opening. The pin has a substantially sharp end facing away from the plate member. A piercing action allows for piercing insulation material through the sharp end of the pin. A retaining action allows to respectively retain the pin and the pierced insulation material with a set of washers.

DETAILED DESCRIPTION OF THE INVENTION

Figure 1A:
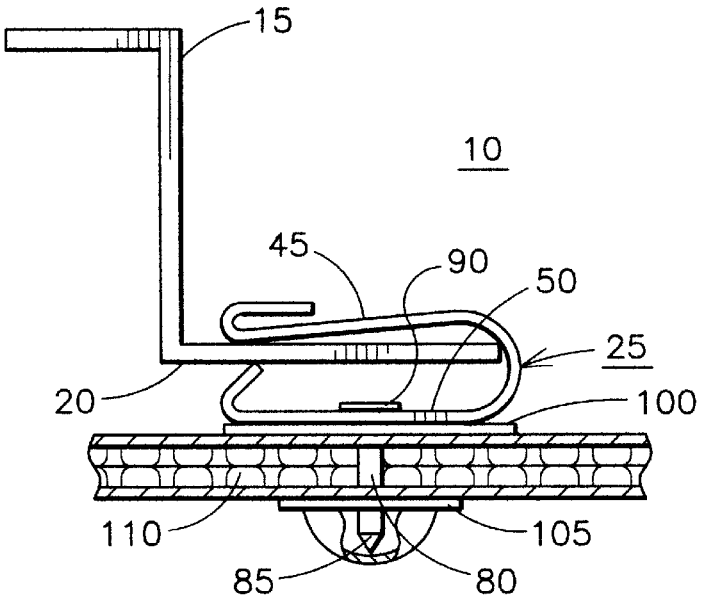
FIG. 1A is a side view of a clip and pin assembly of the present invention in one exemplary combination with a frame member and insulation material.

Referring to FIG. 1, the present invention is made up of a clip and pin assembly 10 that is attachable to a frame member 15 of a building. By way of example, frame member 15 may be configured in various forms, including a stud, joist, purlin, rib, trimmer, etc., and may be used to provide support to a roof or a wall of the building, and includes a flange 20 thereon. Clip 25 has a length dimension 30 extending along a longitudinal axis 35, and a width dimension 40 that is substantially perpendicular to the longitudinal axis 35, which is illustrated more completely in FIGS. 3A and 3B.

Figure 2:
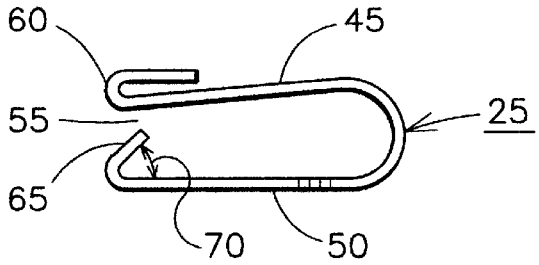
FIG. 2 is a side view of the clip of the present invention.

Referring to FIG. 2, clip 25 has a pair of resilient grabbing members 45, 50 defining an aperture 55 substantially parallel to the longitudinal axis 35. Clip 25 may be formed from a single sheet of metallic material that is bent to form grabbing members 45, 50 and aperture 55. Aperture 55 is sized to receive the flange 20 therein. In one embodiment of the present invention, one of the grabbing members 45 is configured to have a rounded edge 60 proximate the aperture 55, and the other grabbing member 50 is configured to have a projection 65 extending at a predetermined angle 70 toward grabbing member 45. Predetermined angle 70 should be selected to facilitate entry of the flange 20 into the aperture 55 and to frictionally impede exit of the flange 20 from the aperture 55 after the flange 20 has been inserted into the aperture 55.

Referring to FIGS. 1A–1C, 3A, and 3B, at least one opening 75 that is sized to receive and hold a pin 80 therein is included in one of the grabbing members 45, 50. Although FIGS. 1A–1C, 3A, and 3B illustrate that opening 75 is in grabbing member 50, it will be appreciated that opening 75 may just as easily be formed in the other grabbing member 45. Pin 80 includes a sharp end 85 and a head 90. Opening 75 should be sized so that the sharp end 85 may pass through opening 75 but head 90 may not.

In order to enable a user to insert a pin 80 into opening 75, for each such opening 75 a corresponding opening 95 may be included in the opposing grabbing member. Although FIGS. 1A–1C, 3A, and 3B illustrate that corresponding opening 95 is in grabbing member 45, it will be appreciated that opening 95 may just as easily be formed in grabbing member 50 if opening 75 is formed in grabbing member 45. Opening 95 should be sized to pass the entire pin 80 therethrough, and should be positioned so that pin 80 can be passed through opening 95 and into opening 75. Alternatively, it will be noted by those skilled in the art that pin 80 may be incorporated into opening 75 during the manufacture of clip 25.

Figure 1B:
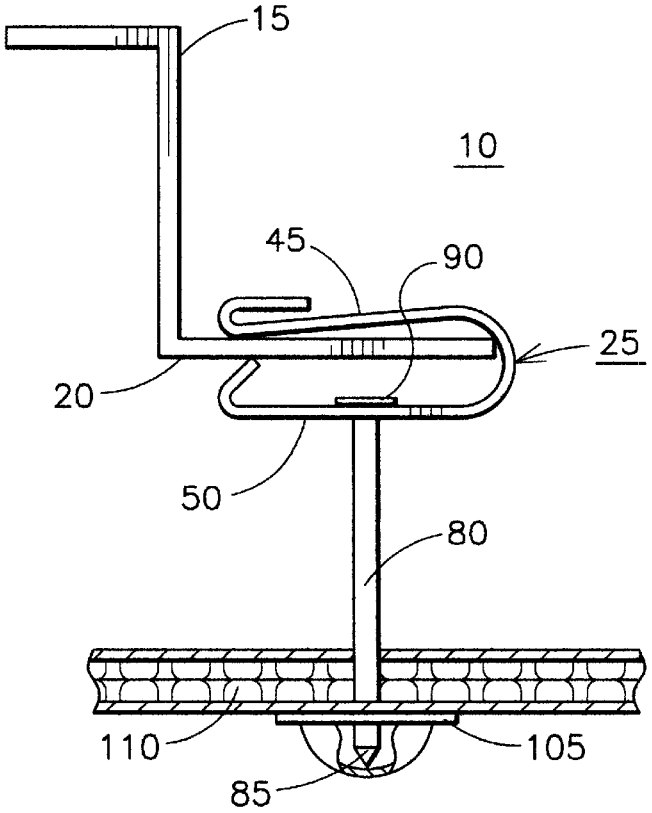
FIG. 1B shows another exemplary combination of the clip and pin assembly of the present invention wherein the insulation is suspended so as to create a thermal barrier and thus lessening heat flow by conduction.
Figure 1C:
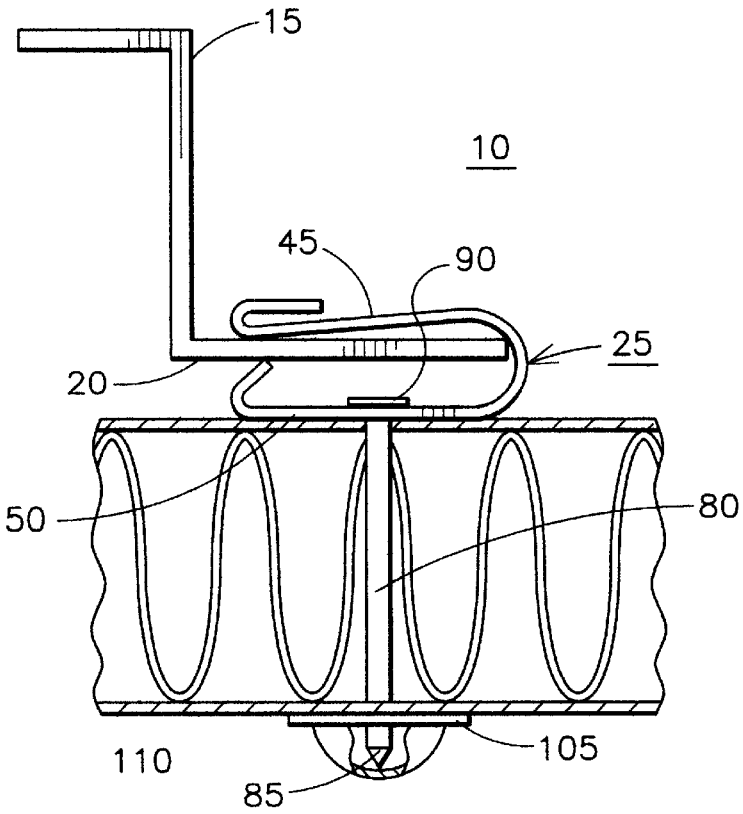
FIG. 1C shows yet another exemplary combination of the clip and pin assembly of the present invention using a mass insulation.

Referring to FIG. 1, a set of washers 100, 105 is connected to the pin 80 as shown. Washer 105 is fixed on pin 80 proximate the sharp end 85, and applies an upward force on the insulation material 110 to retain the insulation material 110 in the pin 80. Washer 100 is fixed on pin 80 proximate the head 90 and applies a force on grabbing member 50 to retain the pin 80 in the opening 75. Pin 80 should be of sufficient size to receive the washers 100, 105 and the insulation material 110 as shown. As shown in FIG. 1B, it will be appreciated that, if desired, the length of pin 80 may be selected sufficiently long so as to allow for creating or interposing a thermal barrier, such as an air gap and the like, between insulation material 110 and frame member 15 so as to reduce conductive heat flow therebetween. In addition, and as better seen in FIG. 1C, the length of pin 80 may be selected to accommodate the thickness of the specific insulation material, e.g., mass insulation, being supported by the clip assembly. Washers 100, 105 are preferably self-locking, with washer 105 being proximate to the sharp end 85 of the pin 80 and providing support against one side of the insulation material 110, and the other washer 100 being opposite the sharp end 85 and providing support against the other side of the insulation material 110. In one embodiment of the present invention, sharp end 85 of pin 80 is capped to protect a user from that sharp end. It will be appreciated that in lieu of capping that sharp end, one may simply cut off the sharp end of the pin upon installation of the insulation.

Figure 3B:
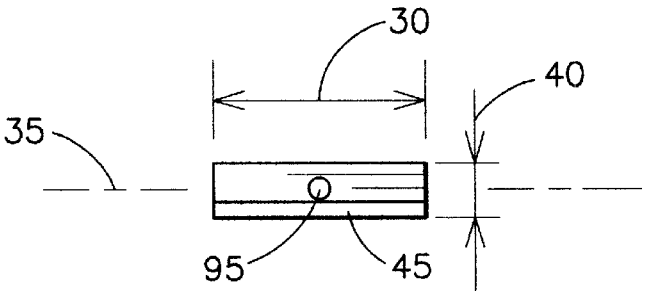
FIG. 3B is a top view of another embodiment of the clip and pin assembly of the present invention.
Figure 3A:
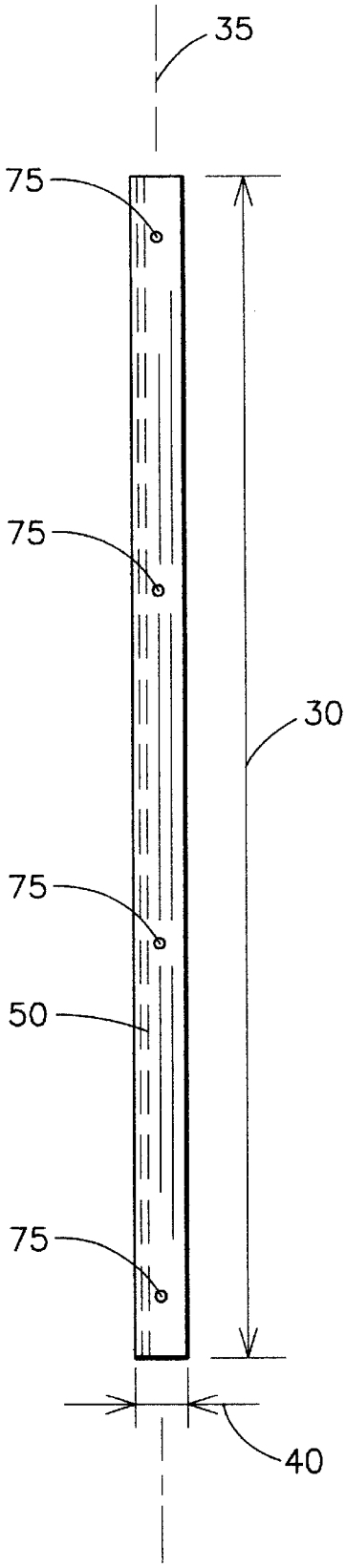
FIG. 3A is a bottom view of one embodiment of the clip and pin assembly of the present invention.

Clip 25 may be sized to have a relatively small length dimension 30, as illustrated in FIG. 3B, or may have a relatively large length dimension 30, as illustrated in FIG. 3A and in this case clip 25 may have a relatively low width to length ratio. Referring to FIG. 3A, for clips 25 with a relatively large length dimension 30, grabbing member 50 may include additional openings 75 positioned along the longitudinal axis 35 for receiving respective additional pins 80. Each opening 75 should include additional washer sets 100, 105 to provide substantially aligned attachment between the insulation material 110 and the frame member 15 along the longitudinal axis 35. A clip 25 having a low width to length ratio may be conveniently selected if there are no physical structures, such as walls, beams and the like, obstructing the placement of such clip on flange 20. If there are physical structures that prevent the use of a clip 25 with a larger length dimension 30, a clip with a smaller length dimension 30 may be selected so that the clip 25 will fit on the flange 20. A clip having a low width to length ratio allows for spanning a correspondingly long section of flange 20 with a single clip. This makes installation of the insulation material less time-consuming and more efficient. Further, the use of a single clip to span a longer section of flange 20 helps ensure that the insulation material will be positioned in a straight line along the length of the flange 20. This will reduce the risk that the insulation material will be misaligned relative to flange 20. It will be appreciated that the clip may be chosen to have any desired length so long as clip 25 maintains its structural integrity, or its handling does not become unwieldy to the user, or difficult to store and transport. The width dimension 40 may be relatively fixed, as the width of flange 20 may not vary much between frame members. However, the width dimension 40 may be sized to correspond to the width of flange 20 if necessary. By way of example of not of limitation, each of the respective embodiments shown in FIGS. 3A and 3B may have a width of about 1.5 inches while the embodiment of FIG. 3A may have a length of about 4 feet compared to a length of about 4 inches for the embodiment of FIG. 3A.

The method of the present invention will now be described in detail. Referring to FIG. 1, a frame member 15 with a flange 20 is provided. The flange 20 is grabbed with a clip 25 having a length dimension 30 and a width dimension 40 as described above. Flange 20 is grabbed by clip 25 by inserting the flange 20 into the aperture 55 defined by the pair of resilient grabbing members 45, 50.

In one embodiment of the present invention, one of the grabbing members 45 is provided with a rounded edge 60 proximate the aperture 55, and the other grabbing member 50 is provided with a projection 65 extending at a predetermined angle 70 toward grabbing member 45. Predetermined angle 70 should be selected to facilitate entry of the flange 20 into the aperture 55 and to frictionally impede exit of the flange 20 from the aperture 55 after the flange 20 has been inserted into the aperture 55. By way of example, such angle may be chosen to be 45 degrees relative to grabbing member 50.

Referring to FIGS. 1, 3A, and 3B, at least one opening 75 that is sized to receive and hold a pin 80 therein is provided in one of the grabbing members 45, 50. Although FIGS. 1, 3A, and 3B illustrate that opening 75 is in grabbing member 50, it will be appreciated that opening 75 may just as easily be formed in the other grabbing member 45. Opening 75 should be sized to pass the sharp end 85 of the pin 80 therethrough, but should not allow the head 90 of the pin 80 to pass therethrough.

The pin 80 is then inserted through opening 75 so that the sharp end 85 faces away from the flange 20. In order to enable a user to insert pin 80 into opening 75, for each such opening 75 a corresponding opening 95 may be included in the opposing grabbing member. Although FIGS. 1, 3A, and 3B illustrate that corresponding opening 95 is in grabbing member 45, it will be appreciated that opening 95 may just as easily be formed in grabbing member 50 if opening 75 is formed in grabbing member 45. Opening 95 should be sized to pass the entire pin 80 therethrough, and should be positioned so that pin 80 can be passed through opening 95 and into opening 75. Alternatively, it will be noted by those skilled in the art that pin 80 may be incorporated into opening 75 during the manufacture of clip 25 and that the clip and pin may be optionally pre-assembled before being delivered to the user.

Referring to FIG. 1, washer 100 is fixed on pin 80 proximate the head 90 and applies a force on grabbing member 50 to retain the pin in the opening 75. Sharp end 85 of pin 80 is then used to pierce the insulation material 110. Finally, washer 105 is fixed on pin 80 proximate the sharp end 85, and applies an upward force on the insulation material 110 to retain the insulation material 110 in the pin 80.

Clip 25 may be sized to have a relatively small length dimension 30, as illustrated in FIG. 3B, or may have a relatively large length dimension, as illustrated in FIG. 3A. Referring to FIG. 3A, for clips 25 with a relatively large length dimension, grabbing member 50 may be provided to include additional openings 75 positioned along the longitudinal axis 35 for receiving respective additional pins 80. By way of example, these additional openings 75 may be positioned substantially equidistant relative to one another along the longitudinal axis 35. The sharp ends 85 of these additional pins 80 are used to pierce the insulation material 110 at multiple points along the length of the material 110. Additional washer sets 100, 105 are provided to retain the additional pins 80 in the additional openings 75 and to retain the pierced insulation material 110 in the additional pins 80.

Figure 4:
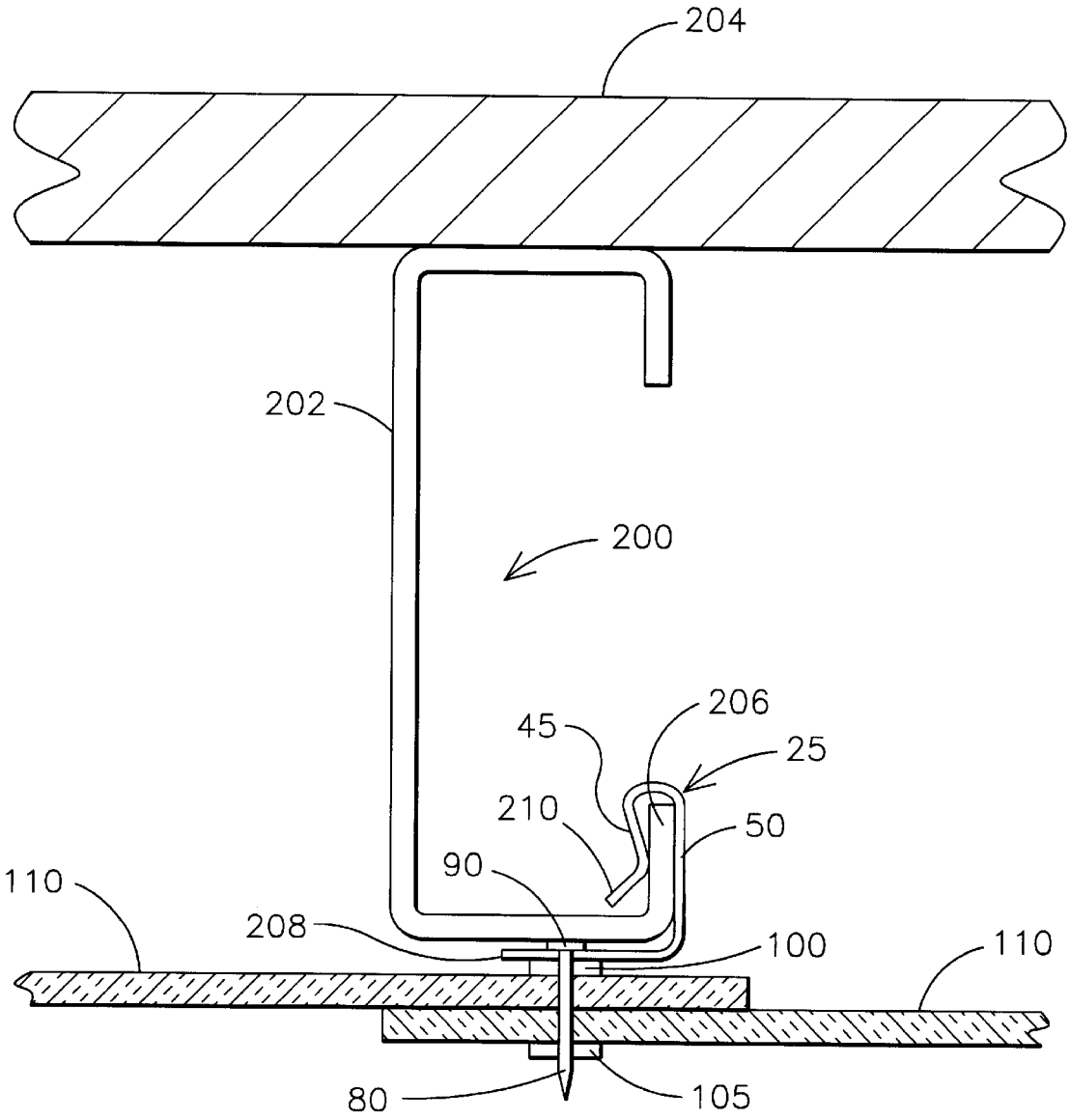
FIG. 4 is a side view of a clip and pin assembly in combination with a frame member having a generally vertically extending flange.

FIG. 4 illustrates an exemplary embodiment of a clip and pin assembly 200 for attaching insulation material that is attachable through the clip to a frame member 202 including a generally vertically extending flange 206 thereon, in lieu of a horizontal flange. By way of example, frame member 202 may comprise a C-purlin and, as will be readily understood by those skilled in the art, such purlin may be used to provide support to a roof 204. It will be appreciated that the embodiment of FIG. 4, in addition to incorporating all of the advantageous features discussed above in the context of FIGS. 1 through 3, allows for attaching the clip to a frame member having a vertically extending flange.

As suggested above, clip 25 has a pair of resilient grabbing members 45, 50 defining an aperture sized to receive the vertically-extending flange 206 therein. In this embodiment, a plate member 208 extends generally perpendicular relative to grabbing members 45 and 50. In this embodiment, plate member 208 includes the opening through which holding pin 80 extends. As suggested above, clip 25 may be formed from a single sheet of metallic material that is bent to integrally form grabbing members 45, 50 and plate member 208. It will thus be appreciated that grabbing members 45, 50 and plate member 208 in one exemplary embodiment are constructed as an integral piece. Although in FIG. 4, plate member 208 is shown to be positioned under frame member 202, it will be appreciated that the present invention is not limited to such construction, being that frame member 202 could have been bent to extend 180 degrees opposite to the direction shown in FIG. 4.

As discussed above, a set of washers 100, 105 may be respectively connected to pin 80 to retain insulation material pierced by the pin and to retain the pin in the opening in the plate member. As shown in FIG. 4, one of the grabbing members, e.g., grabbing member 45, is configured to have a projection 210 extending at a predetermined angle away from the other grabbing member 50. The predetermined angle should be selected to facilitate entry of flange 206 into the aperture defined by the grabbing members.

It is believed that the clip assembly of the present invention provides at least the following advantages:

New and improved method of relatively quickly and inexpensively insulating new and existing buildings.

Secure installation of insulating materials to horizontal and upright building frame members, such as purlins, joists, ribs, etc.

Insulation to cover the bottom of the frame member to create a substantially continuous insulation system with a thermal break or barrier from the frame member based on the longitudinal dimension of the pin.

Support of multiple types of insulation and facings, such as foam boards, also white poly/vinyl facings, and mass insulations including fibrous, cellulose, cotton and reflective insulation by the availability of different pin lengths.

Installation of the insulation in any desired geometrical configuration (e.g., parallel or perpendicular) relative to the building frame member.

A finished and aesthetically pleasing look to the ceiling or walls of the building by covering the beams behind the insulation.

A clip-assembly than can be ruggedly constructed to be safely used to support heavy duty materials. Further, the clip-assembly may be used to secure safety netting.

A clip-assembly readily configured to provide easy sliding entry over a lip or flange of, for example the purlin, and upon entry providing sufficient gripping or frictional force to that lip so that the clip assembly does not become dislodged due to the weight of the insulation. The assembly may be readily removed to perform any necessary maintenance or repairs. The assembly may also be opened by hand or without special tools to be released from the purlin.

A clip-assembly that can be readily installed without special machinery or substantial strength or dexterity.

A clip assembly that will not interfere with the normal use of the building or the frame members therein to which the assemblies are attached.

A clip assembly that can be re-used when the building life cycle is complete and therefore is a recyclable or environmentally-green building component.

It will be understood that the specific embodiment of the invention shown and described herein is exemplary only. Numerous variations, changes substitutions, and equivalents will now occur to those skilled in the art without departing from the spirit and scope of the present invention. Accordingly, it is intended that all subject matter described herein and shown in the accompanying drawings be regarded as illustrative only and not in a limiting sense and that the scope of the invention be solely determined by the appended claims.

I claim as my invention:

1. An assembly for attaching insulation material, the assembly comprising in combination:

a frame member having a generally vertically-extending flange;

a clip having a pair of resilient grabbing members defining an aperture for receiving the flange;

a plate member extending generally perpendicular relative to the grabbing members, said plate member including an opening;

a respective pin having a sharp end, the pin extending through the opening in the plate member; and at least one set of washers connected to the pin to retain insulation material pierced by the pin and to retain the pin in the opening in the plate member.

2. The assembly of claim 1 wherein the pair of grabbing members and the plate member comprise an integral piece.

3. The assembly of claim 1 wherein one of the grabbing members is configured to have a projection extending at a predetermined angle away from the other grabbing member, the predetermined angle chosen to facilitate entry of the flange through the aperture.

4. The assembly of claim 1 wherein the set of washers comprises a pair of self-locking washers, one of the self-locking washers being proximate to the sharp end of the pin and adapted to provide support against one side of the insulation material, the other of the self-locking washers being opposite the sharp end and adapted to provide support against the other side of the insulation material.

5. The assembly of claim 4 wherein the sharp end of the pin is capped to protect a user from said sharp end.

6. The assembly of claim 1 wherein the clip has a low width to length ratio and the plate member includes additional openings positioned along its longitudinal axis for receiving respective additional pins, and further includes additional washer sets to provide substantially aligned attachment between the insulation material and the frame member along said longitudinal axis.

7. A clip for attaching insulation material comprising:

a pair of resilient grabbing members including a first grabbing member and a second grabbing member with an aperture therebetween, said aperture being substantially parallel to a longitudinal axis and being configured to receive a generally vertically extending flange therein, said clip adapted to be supported by said flange, the second grabbing member including a projection extending at a predetermined angle away from the first grabbing member, said predetermined angle being selected to facilitate entry of the flange into said aperture; and a plate member, attached to the first grabbing member, extending generally perpendicular relative to the first grabbing member and in the direction of the second grabbing member, wherein said grabbing members and said plate member comprise an integral piece.

8. The clip of claim 7 further comprising a pin extending through an opening in the plate member.

9. The clip of claim 8 further comprising a set of washers connected to said pin for retaining insulation material pierced by the pin and for retaining the pin in the opening.

10. A method for attaching insulation material, the method comprising:

providing a frame member with a generally vertically-extending flange;

grabbing the flange with a clip having a pair of resilient grabbing members defining an aperture for receiving the flange;

extending a plate member generally perpendicular from the grabbing members, said plate member including at least one opening;

inserting a respective pin through the opening, the pin having a substantially sharp end facing away from the plate member;

piercing insulation material through the sharp end of the pin; and retaining said pin in the opening and further retaining the pierced insulation material with a set of washers.

11. The method of claim 10 further comprising constructing the pair of grabbing members and the plate member to be an integral piece.

12. The method of claim 11 further comprising providing a projection in one of the grabbing members, the projection extending at a predetermined angle away from the other grabbing member, the predetermined angle chosen to facilitate entry of the flange through the aperture.

13. The method of claim 10 wherein the clip has a low width to length ratio and the plate member with the opening includes additional openings positioned along its longitudinal axis.

14. The method of claim 13 further comprising the steps of: providing respective additional pins into the additional openings, each pin having a respective sharp end;

piercing insulation material at multiple points along the length of said material with each respective sharp end of the pins; and retaining the respective additional pins in the additional openings and further retaining the pierced insulation material to the respective additional pins with additional sets of washers.

15. An assembly for attaching insulation material, the assembly comprising in combination:

a) a frame member having a generally horizontally-extending first flange and second flange, attached to the first flange, extending upward therefrom;

b) a clip having a pair of resilient grabbing members including a first resilient grabbing member and a second resilient grabbing member;

c) a plate member, attached to the first grabbing member, extending generally perpendicular to the grabbing members, and said plate member extending subjacent, and generally parallel to the first flange of the frame member; and, d) a fastener attached to the plate member, and adapted to connect insulation material to the plate member.

16. The assembly of claim 15 wherein the pair of grabbing members and the plate member comprise an integral piece.

17. The assembly of claim 15 further comprising at least one set of washers connected to the fastener to retain insulation material pierced by the fastener and to retain the fastener in an opening in the plate member through which the fastener extends.

18. The assembly of claim 17 wherein the set of washers comprises a pair of self-locking washers, one of the self-locking washers being proximate to the sharp end of the pin and adapted to provide support against ones side of the insulation material, the other of the self-locking washers being opposite the sharp end providing support against the other side of the insulation material.

* * * * *